United States Patent [19]

Wang

[11] Patent Number: 4,951,183

[45] Date of Patent: Aug. 21, 1990

[54] FOCUSABLE FLASHLIGHT

[76] Inventor: Howard Wang, No. 7, Alley 14, Lane 64, Ching Ping Rd., Chung Ho City, Taipei Hsien, Taiwan

[21] Appl. No.: 464,900

[22] Filed: Jan. 16, 1990

[51] Int. Cl.[5] ..... F21L 7/00

[52] U.S. Cl. ..... 362/187; 362/202; 362/205

[58] Field of Search ..... 362/187, 202, 205, 207, 362/208

[56] References Cited

U.S. PATENT DOCUMENTS

| | | | |
|---|---|---|---|
| 3,924,116 | 12/1975 | Brindley | 362/205 |
| 4,286,311 | 8/1981 | Maglica | 362/187 |
| 4,388,673 | 6/1983 | Maglicia | 362/205 |
| 4,527,223 | 7/1985 | Maglica | 362/187 |
| 4,881,158 | 11/1989 | Price, III | 362/187 |

*Primary Examiner*—Ira S. Lazarus
*Assistant Examiner*—Richard R. Cole
*Attorney, Agent, or Firm*—Dellett, Smith-Hill and Bedell

[57] ABSTRACT

A flashlight includes a tube with a head provided at a front end. A light reflector is disposed in a front end of the head. A casing is force-fitted within the front end of the tube. A switch is fixed on the casing. An end cap, a spring and an end plate are disposed in an insulator which is received in a retainer. A light bulb is retained in the retainer. The switcher controls an electrical circuit of the flashlight. The light bulb is stable relative to the tube so that a rotation of the head relative to the tube makes the light reflector move relative to the light bulb.

1 Claim, 2 Drawing Sheets

FOCUSABLE FLASHLIGHT

BACKGROUND OF THE INVENTION

The present invention relates to a flashlight, and more particularly to a variable light beam flashlight.

Flashlights with variable light beam and with press type switch button are disclosed in U.S. Pat. No. 4,286,311 (Anthony Maglica, "Flashlight", Ser. No. 968,468, filed Dec. 11, 1978), and in U.S. Pat. No. 4,388,673 (Anthony Maglica, "Variable light beam flashlight and recharging unit", Ser. No. 275,877, filed June 22, 1981).

For enabling a movement of a light bulb forward and rearward relative to a light reflector, a plurality of parts are provided in the flashlight. The configuration of the flashlight is complicate which increases the manufacturing costs thereof.

The present invention has arisen to mitigate and/or obviate the afore-described disadvantages of the conventinal flashlight.

SUMMARY OF THE INVENTION

The primary objective of the present invention is to provide a flashlight which has a relatively compact configuration and a low manufacturing cost.

According to one aspect of the present, there is provided a flashlight which includes a tube with a head provided at a front end. A light reflector is disposed in a front end of the head. A casing is force-fitted within the front end of the tube. A switch is fixed on the casing. An end cap, a spring and an end plate are disposed in an insulator which is received in a retainer. A light bulb is retained in the retainer. The switch controls an electrical circuit of the flashlight. The light bulb is stably retained on the tube so that a rotation of the head relative to the tube makes the light reflector move relative to the light bulb.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
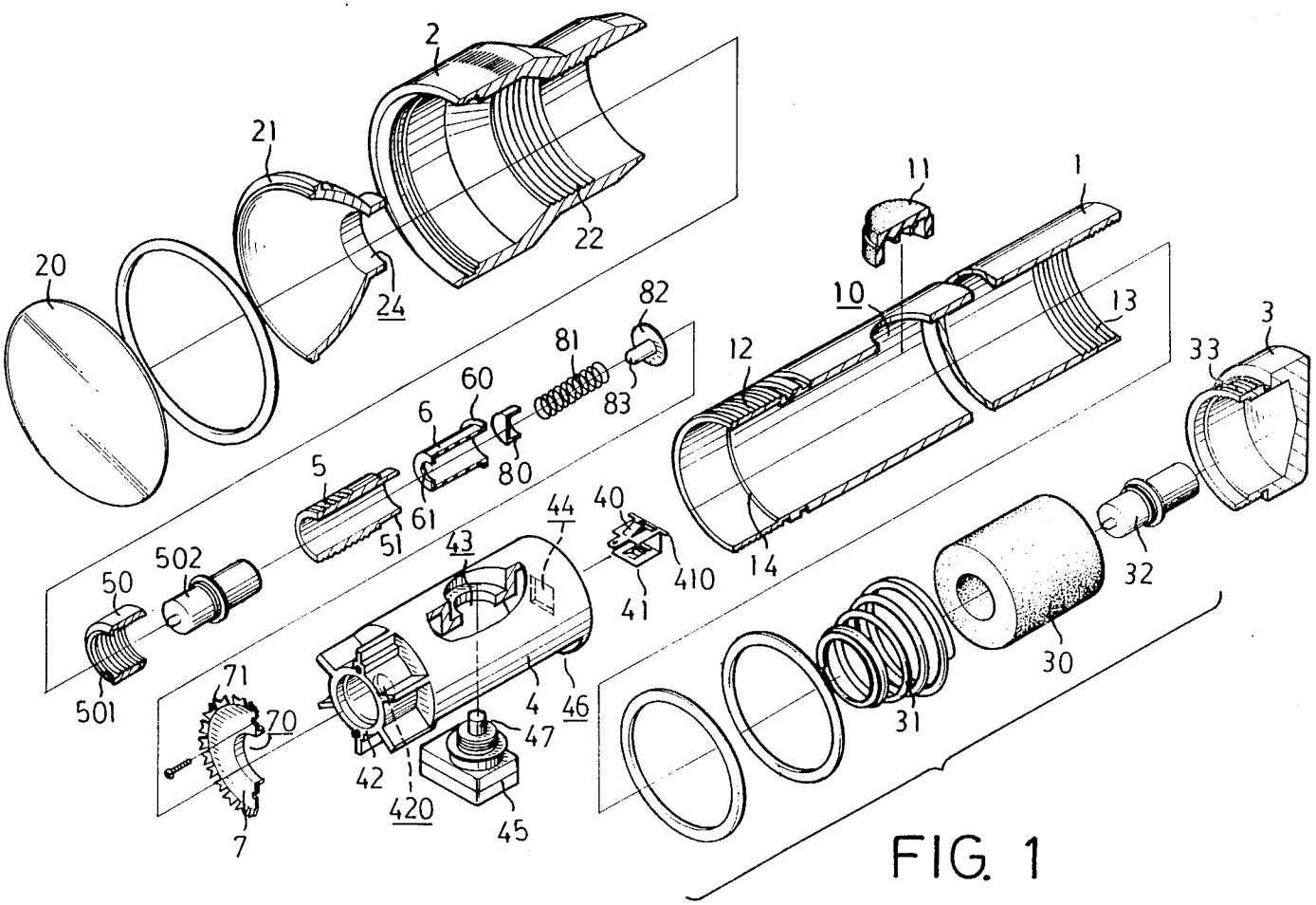
FIG. 1 is an exploded view of a flashlight in accordance with the present invention.

Referring to the drawings, the flashlight in accordance with the present invention comprises generally a cylindrical tube 1 with a head 2 and a tail cap 3 respectively provided at a front end and a rear end thereof. The cylindrical tube 1 may be made in different lengths to receive a selected number of batteries 18.

An outer thread 12 is formed on a front end of the tube 1 and an inner thread 13 is formed in a rear end of the tube 1. A shoulder 14 is formed in the front end of the tube 1. A hole 10 is formed in a front portion of the tube 1 and a lid 11 is insertable into the hole 10. A transparent lens 20 and a light reflector 21 are disposed in a front end of the head 2. A center hole 24 is formed in the rear end of the light reflector 21. An inner thread 22 is formed in a middle portion of the head 2 for making a threaded engagement with the outer thread 12 of the tube 1. An outer thread 33 is formed on a front end of the tail cap 3 so as to make a threaded engagement with the inner thread 13 of the tube 1. A spare light bulb 32 is retained within a foam material 30 which is provided in the tail cap 3. A spring 31 electrically contacts and bears between the tail cap 3 and a negative terminal of the rearmost battery 18.

A disc 7 with a center hole 70 is fixed on a front end of a casing 4 which is inserted into the front end of the tube 1. A plurality of jaws 71 are provided on a peripheral edge of the disc 7 so as to make a force-fitted connection with the inner surface of the tube 1. The shoulder 14 limits a rearward movement of the disc 7 and the casing 4. A reduced diameter cylinder 42 is formed on the front end of the casing 4 and a hole 420 is formed in the inner end of the cylinder 42. An opening 46 is formed on one side of the casing 4. A rectangular hole 44 is formed in the rear end of the casing 4 and a hole 43 is formed in the casing 4 opposite to the opening 46. The hole 43 is aligned with the hole 10 of the tube 1. A press type switch 45 is fixed in the casing 4 so that a button 47 thereof extends beyond the hole 43. The button 47 is engaged within the lid 11 so that the switch 45 is operated by a depression of the lid 11 and the button 47. The switch 45 is insertable into the casing 4 and reachable through the opening 46. A substantially L-shaped conductor 41 has two blades each having a stop 40. A pair of lugs 410 are formed on the rear end of the conductor 41. The conductor 41 is inserted into the rectangular hole 44 of the casing 4 and is retained in position by the lugs 410 and the stops 40. One of the blades of the conductor 41 is electrically connected to the switch 45 by a wire or the like so that the positive terminal of the foremost battery 18 is electrically connected to the switch 45.

An end cap 80, a spring 81 and an end plate 82 with a protrusion 83 are disposed in an insulator 6 in series. An outward flange 60 and an inward flange 61 are respectively formed on a rear end and in a front end of the insulator 6. The end cap 80 bears against the inward flange 61. The insulator 6 is inserted into a retainer 5 which is substantially cylindrical so that the outward flange 60 of the insulator 6 contacts the rear end of the retainer 5. A reduced diameter portion 51 is formed on a rear end of the retainer 5 so as to be force fitted into the cylinder 42. A cover 50 with an inward flange 501 is threadedly engaged on the front end of the retainer 5 so as to retain a light bulb 502 in the retainer 5.

Figure 2:
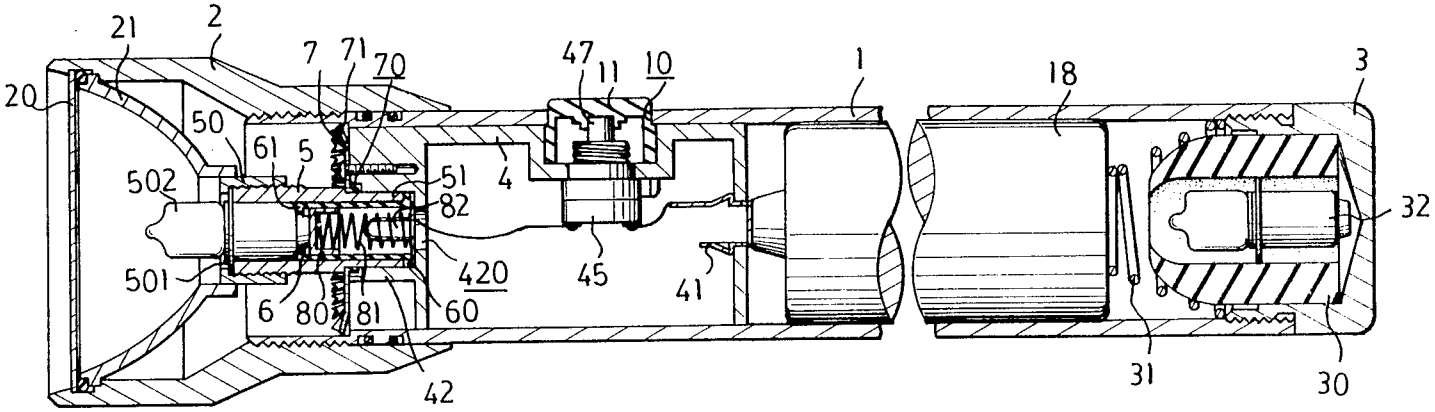
FIG. 2 is a cross sectional view of the flashlight.

As shown in FIG. 2, the end plate 82 is rigidly clamped in the cylinder 42 by the insulator 6 and the retainer 5. The end plate 82 is electrically connected to the switch 45 by a wire or the like so that the center electrode of the light bulb 502 is electrically connected to the switch 45 via the end cap 80, the spring 81 and the end plate 82. The case electrode of the light bulb 502 is electrically connected to the negative terminal of the rearmost battery 18 via the retainer 5, the disc 7, the tube 1 and the spring 31. The switch controls the electrical circuit of the flashlight. The cover 5 is relatively slidable in the center hole 24 of the light reflector 21. The light bulb 502 is stable relative to the tube 1 so that a rotation of the head 2 relative to the tube 1 makes the light reflector 21 move relative to the light bulb 502.

Accordingly, the flashlight in accordance with the present invention has a compact configuration and uses fewest parts so that the manufacturing cost thereof is greatly reduced.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A flashlight comprising a tube with a head and a tail cap respectively provided at a front end and a rear end thereof; said tube being made in different lengths to receive a selected number of batteries; a circular hole being formed in said tube; a lens and a light reflector being disposed in a front end of said head; said head being rotatable and movable relative to said tube; a first spring being electrically contacted between said tail cap and a rearmost battery; a disc with a center hole being fixed on a front end of a casing which is inserted into said front end of said tube; a plurality of jaws being provided on a peripheral edge of said disc so as to be force-fitted within said front end of said tube; a cylinder of reduced diameter being formed on said front end of said casing; an opening being formed on one side of said casing; a rectangular hole being formed in a rear end of said casing and a round hole being formed in said casing opposite to said opening; said round hole being aligned with said circular hole of said tube; a switch being fixed in said casing with a button thereof extending beyond said round hole of said casing and said circular hole of said tube so that said switch is operable by a depression of said button; a conductor which has two blades, each having a stop, being retained in said rectangular hole of said casing; said conductor which is electrically connected to a positive terminal of a foremost battery being electrically connected to said switch; an end cap, a second spring and an end plate with a protrusion being disposed in an insulator; an outward flange and an inward flange being respectively formed on a rear end and in a front end of said insulator; said end cap bearing against said inward flange of said insulator; said insulator being inserted into a retainer; said outward flange of said insulator contacting a rear end of said retainer; a rear end of said retainer being force fitted into said cylinder; a cover with an inward flange being threadedly engaged on a front end of said retainer so as to retain a light bulb therein; a center electrode of said light bulb being electrically contacted to said switch via said end cap, said second spring and said end plate; a case electrode of said light bulb being electrically connected to a negative terminal of a rearmost battery via said retainer, said disc, said tube and said first spring; said switch controlling an electrical circuit of said flashlight; said light bulb being stable relative to said tube so that a rotation of said head relative to said tube makes said light reflector move relative to said light bulb.

* * * * *